United States Patent [19]

Burnett et al.

[11] Patent Number: 4,632,131

[45] Date of Patent: Dec. 30, 1986

[54] FOAMED, EXTRUDED, COHERENT MULTISTRAND SMOKING ARTICLES

[75] Inventors: George H. Burnett; Gus D. Keritsis, both of Richmond; Richard A. Thesing, Glen Allen; Alline R. Wayte; Jose G. Nepomuceno, both of Richmond; Alex S. Gergely, Powhatan, all of Va.

[73] Assignee: Philip Morris Incorporated, New York, N.Y.

[21] Appl. No.: 740,325

[22] Filed: Jun. 3, 1985

Related U.S. Application Data

[63] Continuation-in-part of Ser. No. 627,407, Jul. 3, 1984, abandoned.

[51] Int. Cl.[4] ..... A24B 3/14

[52] U.S. Cl. ..... 131/355; 131/77; 131/78; 131/79; 131/80; 131/369; 131/375

[58] Field of Search ..... 131/77, 78, 79, 80, 131/375, 369, 370, 364, 365

[56] References Cited

U.S. PATENT DOCUMENTS

| | | |
|---|---|---|
| 235,885 | 12/1880 | Lindsley . |
| 235,886 | 12/1880 | Lindsley . |
| T912,011 | 7/1973 | Harpham . |
| 2,349,551 | 5/1944 | Helm . |
| 2,433,877 | 1/1948 | Wells et al. . |
| 2,445,338 | 7/1948 | Sowa . |
| 2,485,670 | 10/1949 | Sowa et al. . |
| 2,592,553 | 4/1952 | Frankenburg et al. . |
| 2,598,680 | 6/1952 | Frankenburg . |
| 2,708,175 | 5/1955 | Samfield et al. . |
| 2,845,933 | 8/1955 | Samfield et al. . |
| 3,012,562 | 12/1961 | Merritt . |
| 3,085,580 | 4/1963 | Muth . |
| 3,098,492 | 7/1963 | Wurzburg et al. . |
| 3,141,462 | 7/1964 | Block et al. . |
| 3,166,078 | 1/1965 | Parmele et al. . |
| 3,203,432 | 8/1965 | Green et al. . |
| 3,209,763 | 10/1965 | Parmele et al. . |
| 3,223,090 | 12/1965 | Strubel et al. . |
| 3,298,062 | 1/1967 | Nicholl . |
| 3,313,003 | 4/1967 | O'Brien . |
| 3,353,541 | 11/1967 | Hind et al. . |
| 3,364,935 | 1/1968 | Moshy et al. . |
| 3,373,751 | 3/1968 | Wallberg . |
| 3,404,690 | 10/1968 | Moshy et al. . |
| 3,404,691 | 10/1968 | Moshy et al. . |
| 3,410,279 | 11/1968 | Moshy et al. . |
| 3,411,515 | 11/1968 | Hind et al. . |
| 3,424,170 | 1/1969 | Grunwald et al. . |
| 3,467,109 | 9/1969 | Block et al. . |
| 3,528,434 | 9/1970 | Halter et al. . |
| 3,529,602 | 9/1970 | Hind et al. . |
| 3,613,693 | 10/1971 | Monte . |
| 3,760,815 | 9/1973 | Deszyck . |
| 3,820,548 | 6/1974 | Buchmann et al. . |
| 3,865,120 | 2/1975 | Detert et al. . |
| 3,894,544 | 7/1975 | Egri . |
| 3,931,824 | 1/1976 | Miano et al. . |
| 3,932,081 | 1/1976 | Buchmann et al. . |
| 3,968,804 | 7/1976 | Kelly et al. . |
| 3,983,884 | 10/1976 | Detert et al. . |
| 4,083,371 | 4/1978 | Beringer et al. . |
| 4,233,993 | 11/1980 | Miano et al. ..... 131/354 |
| 4,333,484 | 6/1982 | Keritsis ..... 131/359 |
| 4,340,072 | 7/1982 | Bolt et al. . |
| 4,347,855 | 9/1982 | Lanzillotti et al. . |
| 4,391,285 | 7/1983 | Burnett et al. . |
| 4,506,684 | 3/1985 | Keritsis et al. ..... 131/369 |
| 4,513,756 | 4/1985 | Pittman et al. . |

FOREIGN PATENT DOCUMENTS

| | | |
|---|---|---|
| 951209 | 7/1974 | Canada . |
| 056308 | 7/1982 | European Pat. Off. . |
| 1167717 | 4/1964 | Fed. Rep. of Germany . |
| 1532104 | 7/1969 | Fed. Rep. of Germany . |
| 2358657 | 7/1974 | Fed. Rep. of Germany . |
| 1782854 | 8/1974 | Fed. Rep. of Germany . |
| 2410168 | 9/1975 | Fed. Rep. of Germany . |
| 143799 | 11/1979 | Netherlands . |
| 690838 | 2/1969 | South Africa . |
| 282369 | 11/1927 | United Kingdom . |
| 1055445 | 1/1967 | United Kingdom . |
| 2064296 | 6/1981 | United Kingdom . |

*Primary Examiner*—V. Millin

*Attorney, Agent, or Firm*—Robert M. Isackson

[57] ABSTRACT

An extruded, coherent, multistrand, tobacco-containing, generally cylindrical smoking article and a process for making it are disclosed. The smoking article contains a plurality of strands that are adhered to one another so as to form passageways between the strands, the passageways extending generally along the longitude of the smoking article. The configuration of the strands and passageways provides sufficient heat transfer area and/or residence time for the smoke drawn by a smoker to cool to an acceptable level.

43 Claims, 10 Drawing Figures

FOAMED, EXTRUDED, COHERENT MULTISTRAND SMOKING ARTICLES

CROSS REFERENCE TO RELATED APPLICATIONS

This application is a continuation-in-part application of application Ser. No. 627,407 filed July 3, 1984 by George Henry Burnett, Gus D. Keritsis, Alline R. Wayte, and Jose G. Nepomuceno, entitled FOAMED, EXTRUDED, COHERENT MULTISTRAND SMOKING ARTICLES now abandoned.

BACKGROUND

Manufactured tobacco and smoking articles are well-known. See, e.g., U.S. Pat. Nos. 235,885; 235,886; 2,433,877; 2,445,338; 2,485,670; 2,592,553; 2,598,680; 3,085,580; 3,098,492; 3,203,432; 3,209,763; 3,223,090; 3,298,062; 3,313,003; 3,353,541; 3,364,935; 3,373,751; 3,404,690; 3,404,691; 3,410,279; 3,528,434; 3,529,602; 3,894,544; 3,931,824; 3,932,081; 4,083,371; 4,233,993; 4,333,484; 4,340,072; 4,347,855; 4,391,285; U.S. Defensive Publication No. T912,011; German Publication Nos. 1,167,717; 1,532,104; 1,782,854; 2,358,657; 2,410,168; and 2,633,627; Canadian Pat. No. 951,209; U.K. Publication Nos. 282,369 and 2,064,296; Swiss Pat. No. 275,420; Belgian Publication No. 828503; South African Publication No. 69/838; Netherlands Publication No. 143,799; and commonly assigned U.S. Pat. No. 4,510,950, issued Apr. 16, 1985, each of which is hereby incorporated by reference in its entirety. Some of those documents refer to extrusion of strands or filaments of tobacco or to extrusion of tobacco rods containing axially directed air channels.

One approach to making a foamed, extruded smoking article is disclosed in commonly assigned U.S. Pat. No. 4,510,950 and co-pending and commonly assigned U.S. patent application Ser. No. 723,883 filed April 16, 1985. The smoking article is typically substantially cylindrical and is extruded under conditions such that the water in the wet blend fed to the extruder die is converted to steam, thereby foaming the article. The article is monolithic, that is, it is extruded as a single strand with a diameter of typically about 8 mm if the article is a cigarette.

Although that article represents an advance over the art, in certain cases the article has been found to soften sufficiently during smoking to cause the article to collapse. Additionally, in some cases the resistance-to-draw (RTD) of the article has been too high and/or difficult to control.

Accordingly, there is a continuing need for smoking articles that can be manufactured easily, whose RTD and other physical properties can be easily controlled within desired ranges, and which are well accepted in the marketplace.

SUMMARY OF THE INVENTION

The present invention solves those and other problems, as will be explained below. Broadly, the present invention concerns an extruded, coherent, multistrand, tobacco-containing, generally cylindrical smoking article comprising a plurality of co-extruded strands that extend generally along the longitude of the smoking article and are adhered to one another so as to leave flow passageways between the strands, which passageways extend generally along the longitude of the smoking article, the configuration of the strands and passageways providing sufficient heat transfer area or sufficient residence time or both for the hot gases drawn towards the proximal end of the smoking article by a smoker to cool and to exit the proximal end at a comfortable temperature for the smoker, the smoking article also comprising (a) from about 5 to about 98 wt. % of tobacco particles having a particle size of up to about 5 mesh, (b) from 0 to about 60 wt. % of a filler having a particle size of up to about 350 μm, (c) from 0 to about 1.0 wt. % of a residual foaming agent, (d) from about 2 to about 40 wt. % of a binder selected from the groups of (1) cellulosic binders consisting of hydroxypropyl cellulose, carboxymethyl cellulose and its sodium, potassium, and ammonium salts, cross-linked carboxymethyl cellulose and its sodium, potassium, and ammonium salts, hydroxyethyl cellulose, ethyl hydroxyethyl cellulose, hydroxypropyl methyl cellulose, methyl cellulose, ethyl cellulose, and mixtures thereof; or (2) natural binders, modified natural binders, and synthetic binders consisting of pectin and its ammonium, sodium, and potassium salts, starch, guar and derivatives thereof, hemicellulose, xanthan, curdlan, a salt of xanthamonas gum, carageenan, alginic acid and its ammonium, sodium, and potassium salts, chitosan and its water soluble salts, oxycellulose, polyvinyl maleic acid polymer and its ammonium, sodium, and potassium salts, microcrystalline cellulose, dextran, dextrin, fibrous cellulose, and mixtures thereof; or (3) a mixture of cellulosic, natural, modified natural, or synthetic binders and (e) from about 5 to about 20 wt. % water, the article having a density within the range of from about 0.05 to about 1.5 g/cc. In the preferred embodiment, the strands are randomly adhered to each other along their outer surfaces. The term foamed is used in the context of providing the finished article with a density in the aforementioned range through changing the moisture or other foaming agent from a superheated liquid or a compressed gaseous state to a gaseous state by rapid volatilization or decomposition of the foaming agent during extrusion or post-extrusion processing of the material. The effect is to lead to increased cell size in the individual strands and reduced pressure drop in the article. Post-extrusion processing may include, for example, a microwave cavity that uses microwaves of a frequency responsive to the resonant frequency of the moisture or other foaming agent so as to excite the moisture or other foaming agent to be converted into steam or other gaseous product or to cause the extruded strands to heat and become tacky, so as to adhere to each other at locations along their longitudinal length.

In one aspect, the invention concerns making a foamed, extruded, coherent, multistrand, tobacco-containing, generally cylindrical smoking article comprising a plurality of co-extruded strands that extend generally along the longitude of the smoking article and are adhered, preferably randomly, to one another as a result of the co-extrusion process so as to form leave flow passageways between the strands, which passageways are preferably randomized and extend generally along the longitude of the smoking article, the configuration of the strands and passageways providing sufficient heat transfer area or sufficient residence time or both for the hot gases drawn towards the proximal end of the smoking article by a smoker to cool and to exit the proximal end at a comfortable temperature for the smoker, the method comprising the steps of: mixing together from about 5 to about 98 wt. % of tobacco particles having a particle size of up to about 5 mesh and an OV value of from about 3 to about 20%, from 0 to about 60 wt. % of a filler having a particle size of up to about 350 μm, from 0 to about 50 wt. % of a foaming agent including any solvent or vehicle other than water, from about 2 to about 40 wt. % of a binder selected from the group consisting of cellulosic binders, natural binders, modified natural binders, and mixtures thereof, and water to form a wet blend containing from about 15 to about 50 wt. % of water; and extruding the wet blend through a die having a plurality of holes under extrusion conditions of temperature and pressure such that as the wet blend is extruded, thereby forming a plurality of strands, (i) the moisture or other foaming agent in said blend is converted to steam or other gaseous product so as to foam each strand and (ii) the strands adhere randomly to one another along their outer surfaces.

In another aspect of the invention, the wet blend may be extruded through a die having a plurality of holes thereby forming a plurality of strands which are then processed in a drying chamber under conditions that cause the moisture or other foaming agent in the strands to be converted to steam or other gaseous product, thereby foaming the article, and cause the surface of the individual strands to become tacky so that they will adhere, preferably randomly, to each other along their outer surfaces.

In yet another aspect of the invention, the strands may adhere together independent of the extrusion conditions and temperature and post-extrusion drying by the application of an adhesive or other manufacturing process that will produce a tacky surface on the individual strands so that the strands will adhere to each other along their outer surfaces.

In one embodiment, the method ("Method A") comprises the steps of:

(a) dry blending (i) from about 5 to about 98 wt. % of tobacco particles having a particle size of up to about 5 mesh and an OV value of from about 3 to about 20% with (ii) from 0 to about 60 wt. % of a filler having a particle size of up to about 350 μm, (iii) from 0 to about 50 wt. % of a foaming agent, including any solvent or vehicle other than water, and (iv) from about 2 to about 40 wt. % of a binder selected from the group consisting of cellulosic binders, natural binders, modified natural binders, synthetic binders, and mixtures thereof;

(b) admixing the dry blend from step (a) with water to form a wet blend containing from about 15 to about 50 wt. % of water;

(c) extruding the wet blend from step (b) through a die having a plurality of holes, under one of the following extrusion conditions of temperature and pressure, such that: (1) as the wet blend is extruded, thereby forming a plurality of strands, (i) the moisture or other foaming agent in said blend is converted to steam or other gaseous product so as to foam each strand and (ii) the strands adhere to one another along their outer surfaces; or (2) the wet blend is extruded, thereby forming a plurality of strands which are processed in a drying chamber under conditions that (i) cause the moisture or other foaming agent in the strands to be converted to steam or other gaseous product, thereby foaming the strands, and (ii) thereby cause the outer surfaces of the individual strands to become tacky so that the strands will adhere to each other along their length; or (3) the wet blend is extruded, thereby forming a plurality of strands that are foamed in accordance with step (1)(i) or step (2)(i) wherein the strands are also processed by the application of an adhesive, similar material, or other manufacturing process under conditions that will produce a tacky surface on the individual strands so that the strands will adhere to each other along their outer surfaces.

In an alternate embodiment, the method ("Method B") comprises the steps of:

(1) dry blending from about 5 to about 98 wt. % of tobacco particles having a particle size of up to about 5 mesh and an OV value of from about 3 to about 20% with from 0 to about 60 wt. % of a filler having a particle size of up to about 350 μm and from 0 to about 50 wt. % of a foaming agent including any solvent or vehicle other than water;

(2) prehydrating from about 2 to about 40 wt. % of a binder selected from the group consisting of cellulosic binders, natural binders, modified natural binders, synthetic binders, and mixtures thereof by mixing the binder with water or similar solvent to activate the adhesive character of the binder;

(3) admixing the dry blend from step (1) and the prehydrated binder from step (2) to form a wet blend containing from about 15 to about 50 wt. % of water; and (4) extruding the wet blend from step (3) as set forth in Method A step (c).

In extrusion step (2) of either Method A step (c) or Method B step (4), the resulting individual strands may be brought together after extrusion for adhesion in a drying chamber, preferably a microwave cavity, where the strands are heated so as to foam the individual strands and preferably to become hot and sticky and adhere to each other to form the flow pathways without the necessity of using any additional adhesive binder material. The strands exiting the extruder may be placed on a conveyor belt made of a material not affected by, for example, microwaves when advancing the strands into a microwave drying cavity. The conveyor may be progressively conformed to wrap about the strands in a manner resembling the wrapping of shredded tobacco with cigarette paper. Thus the individual strands are wrapped, contacted together and passed through the drying chamber so that they will be adhered together having flow passageways upon exiting the drying chamber. In accordance with extrusion step (3) of either Method A step (c) or or Method B step (4), when an adhesive or the like is separately applied to the extruded strands, it is preferably added before a drying step.

In another aspect, the present invention relates to a die used to form the coherent, multistrand smoking article.

The smoking article of this invention is easy to manufacture and its RTD and other physical properties can be easily controlled within desired ranges. Additionally, the multistrand, coherent smoking article displays a surprising combination of properties. Its stiffness and resistance to collapse are significantly better than a single strand's but the RTD, density, taste, and other properties are still within commercially favorable ranges. That is surprising because the physical complexity of manufactured smoking articles is such that correcting one unfavorable product variable usually results in another becoming unfavorable. For example, the stiffness of the single strand smoking article could be rendered favorable by increasing the density or changing the composition but the former change would require excessive amounts of tobacco per article and raise its RTD and the latter change would probably change the taste of the article.

Other advantages of the present invention will be apparent from this specification.

BRIEF DESCRIPTION OF THE DRAWINGS

To facilitate further discussion of the invention, the following drawings are provided in which.

DETAILED DESCRIPTION OF THE INVENTION

Figure 1:
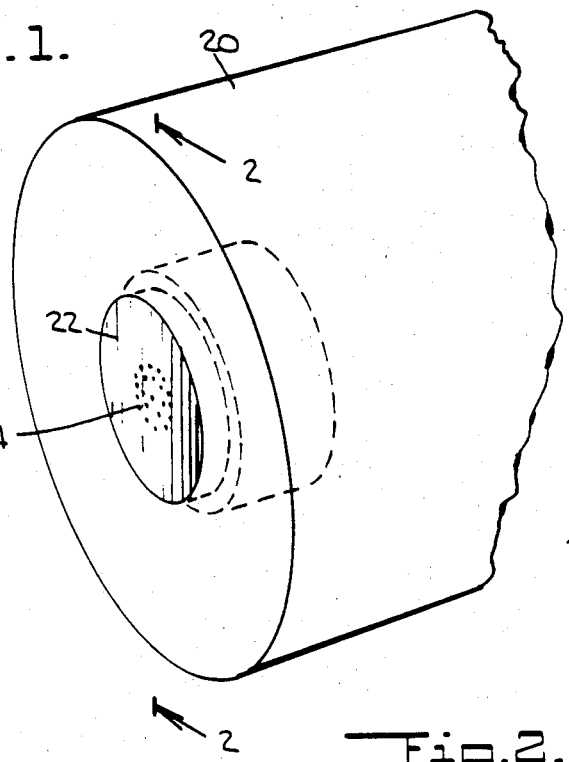
FIG. 1 is a perspective view of the end of the barrel of an extruder showing the preferred die of this invention.

The extruded, coherent, multistrand, generally cylindrical smoking article of this invention comprises a plurality of co-extruded strands that are adhered to one another as a result of the co-extrusion process used to make the article or during post-extrusion processing of the extruded strands. The adherence results in the article being "coherent," that is, a unitary structure of strands sufficiently joined to one another rather than being a mere assemblage of separate or insufficiently joined strands. The strands are "co-extruded" in the sense that they exit different holes of the same die, desirably at substantially the same linear velocity as one another. In the preferred embodiment, the strands are randomly adhered to one another leaving randomized pathways along the length of the article.

The configuration of the strands and passageways provides sufficient heat transfer area or sufficient residence time or both for the hot gases drawn towards the proximal end of the smoking article by a smoker to cool and to exit the proximal end at a comfortable temperature for the smoker. By "comfortable temperature" is meant less than 150° F., usually less than 135° F., preferably less than 120° F., and most preferably less than 100° F.

If the strands are separate or if they are insufficiently joined, strands may move longitudinally and fall out of the smoking article or the strands may move radially and the smoking article may lose its generally cylindrical shape. Furthermore, the random adherence in combination with the proper arrangement of the strands to form the randomized passageways between the strands prevents any extensive channeling of the gas/aerosol drawn by the smoker. Such channeling prevents the gas/aerosol from contacting sufficient surface area and/or from having sufficient residence time in the smoking article to cool the gas/aerosol sufficiently. The "coherent" nature of the multistrand smoking article is such that it has the look and feel of a smoking article (e.g., cigarette) made by a conventional process. However the smoking article is formed, twisting of the coherent strands or rope reduces the channeling of the smoke through the passageways. This forms a more tortuous path, increasing the path length and increasing the relative RTD.

Adhering strips or strands of tobacco material to one another after the strips or strands have been formed singly and are relatively dry does not result in a product of this invention. Except as provided for by the additional application of an adhesive, special processing conditions, or twisting, such a smoking article will generally not have the required balance of properties, e.g., the internal tortuosity to cool the gas/aerosol sufficiently, acceptable RTD, density, taste, feel, and so forth.

Furthermore, as will be explained below, many factors will affect whether a smoking article extruded from a composition within the present invention forms a coherent smoking article with the required passageways. Some of the factors are type of extruder, die configuration, amount and type of binder and other additives (e.g., stiffening agents), amount of water in the composition, operating temperatures in the extruder or post-extrusion drying section, and extrusion velocity.

The tobacco used herein may be any type of tobacco and will generally be comminuted tobacco selected from the group consisting of bright, burley, oriental, and mixtures thereof, comminuted reconstituted tobacco, comminuted stems, tobacco dust or fines, and mixtures thereof. The tobacco may have been previously subjected to a stiffening or expansion process to increase its filling power. The smoking article contains from about 5 wt. % to about 98 wt. % tobacco and preferably from about 25–98 wt. %.

Whatever the source of the tobacco particles, the particles employed in the present invention will have a particle size of up to about 5 mesh. Preferably, substantially all the particles will be less than 35 mesh, and more preferably will be less than 50 mesh. When particle sizes greater than 35 mesh are employed, it may be necessary to add a polyfunctional acid, such as citric or phosphoric acid and their ammonium, sodium, and potassium salts, during formation of the wet blend in order to achieve the desired appearance and foaming of the extruded article. The polyfunctional acid or its salts is added in an amount such that the smoking article contains from about 0.1 to about 15 wt. % thereof, preferably from about 2 to about 10 wt. %.

The binder is preferably selected from the group consisting of cellulosic binder, natural binders, modified natural binders, synthetic binders and mixtures thereof. The cellulosic binder is selected from the group consisting of hydroxypropyl cellulose, carboxymethyl cellulose and its sodium, potassium, and ammonium salts, cross-linked carboxymethyl cellulose and its sodium, potassium, and ammonium salts, hydroxyethyl cellulose, ethyl hydroxyethyl cellulose, hydroxypropyl methyl cellulose, methyl cellulose, ethyl cellulose, and mixtures thereof.

The cellulosic binder is preferably selected from the group consisting of hydroxypropyl cellulose, carboxymethyl celluose and its ammonium and alkali metal salts, hydroxyethyl cellulose, and mixtures thereof. A mixture of carboxymethyl cellulose and hydroxypropyl celluose is particularly preferred. The cellulosic binder is present in the smoking article in an amount of from 0 to about 40 wt. % and preferably from about 1 to about 30 wt. %.

The natural binders, modified natural binders, and synthetic binders are selected from the group consisting of pectin and its sodium, potassium, and ammonium salts, starch, guar, chitin, chitosan, xanthan, and derivatives thereof (e.g., hydroxypropyl guar), hemicellulose, curdlan, a salt of xanthamonas gum, carageenan, oxycellulose, polyvinyl alcohol, vinyl maleic anhydride polymer, vinyl maleic acid polymer and its sodium, potassium, and ammonium salts, microcrystalline cellulose, dextran, dextrin, fibrous cellulose, and mixtures thereof. The natural, modified natural, and synthetic binders are present in the smoking article in an amount from 0 to about 40 wt. %.

The total amount of binder present in the smoking article is in the range from about 2 to about 40 wt. %. A typical binder combination is 5 wt. % hydroxypropyl cellulose, 2.5 wt. % carboxymethyl cellulose, and 2.5 wt. % starch. Another typical combination is 1 wt. % hydroxypropyl cellulose, 4 wt. % hydroxypropyl guar and 5 wt. % starch.

The article may also include as a filler any particulate material having a particle size of up to about 350 μm that is compatible with the other components of the blend. The filler is preferably selected from the group consisting of calcium carbonate, magnesium carbonate, calcium oxide, magnesium oxide, calcium hydroxide, magnesium hydroxide, metallic aluminum, alumina, hydrated alumina, clay, silica, and mixtures thereof and preferably is calcium carbonate. When the filler is added, it is added in an amount so that it is from about 5 to about 60 wt. % of the smoking article.

The dried or equilibrated smoking article contains from about 5 to about 20 wt. % water, which is typically measured as oven volatiles (OV). Preferably, the smoking article contains from about 8 to about 17 wt. % water.

The smoking article has a density of from about 0.05 to about 1.5 g/cc, preferably from about 0.10 to about 1.0 g/cc. The articles comprise a porous structure that permits static burning and the passage of smoke (gas/aerosol) through the article to the smoker. The density of the article is related to the porous structure and the voids created between the strands, and an article having a density within the specified range and having the randomized passageways of this invention provides good burn rate and transmission of smoke to the smoker.

The smoking articles may also include from about 0.001 to about 1 wt. % of an alcohol compatible with the cellulosic binder, that is, an alcohol in which the cellulosic binder is soluble. That alcohol is selected from the group consisting of ethanol, methanol, isopropanol, n-propanol, and mixtures thereof. The alcohol present in the smoking article may result from adding alcohol during the formation of the article to lower the moisture content of the extrudate at the die or may be residual alcohol as a result of adding flavor casings.

The smoking article may also contain from about 0.1 to about 40 wt. %, preferably from about 0.5 to about 20 wt. %, of a cross-linking or stiffening agent. The stiffening agent which is added prior to extrusion and then cross-linked during extrusion is selected from the group consisting of alginic acid, carboxymethyl chitin, pectinic acid, chitosan, carboxymethyl chitosan, water soluble salts thereof, and mixtures thereof. From about 0.1 to about 10.0 wt. % of a water soluble salt of calcium, magnesium, and/or aluminum may also be used.

The smoking articles are preferably formed as generally cylindrical, coherent, multistrand articles having a diameter of from about 2 to about 35 mm, preferably from about 4 to about 25 mm. Alternate cross-sectional configurations may be made with an appropriate die, for example, oval, star-shaped, cylindrical, and the like, or shaped appropriately in a post-extrusion process. These rods are typically made in conventional cigarette or cigar lengths and may be wrapped with cigarette paper, a cigar wrapper, or a co-extruded shell of combustible material or the like. The articles may be thus marketed as non-filtered "cigarettes" or as "cigars." A conventional filter may be joined to the "cigarette" by tipping paper to form a filtered smoking article.

Various flavorants and/or humectants that are commonly employed in the manufacture of smoking articles may be added prior to extrusion or may be subsequently added to the extruded article.

The method of the present invention comprises mixing or blending together tobacco particles with binder, filler, foaming agent, cross-linking or stiffening agent, and any other desired ingredient with water or similar solvent to form a wet blend, and extruding the wet blend through a die having a plurality of holes in accordance with one of the following extrusion conditions such that (1) as the wet blend is extruded, thereby forming a plurality of strands, (i) the moisture or other foaming agent in the blend is converted to steam or other gaseous product so as to foam each strand as it exits the die of the extruder and (ii) the strands adhere to one another; or (2) the wet blend is extruded to form a plurality of strands which are processed in a drying chamber under conditions that (i) cause the moisture or other foaming agent in the strands to be converted to steam or other gaseous product, thereby foaming the strands, and (ii) thereby cause the outer surfaces of the individual strands to become tacky so that the strands will adhere to each other along their length; or (3) thereby forming a plurality of strands that are foamed in accordance with step (1)(i) or step (2)(i) wherein the strands are also processed by the application of an adhesive, similar material, or other manufacturing process under conditions that will produce a tacky surface on the individual strands so that the strands will adhere to each other along their outer surfaces.

Mixing of the tobacco, cellulosic binder, filler, water, and other desired ingredients may be carried out in any conventional mixing device. The resulting mixture is to be a wet blend containing from about 15 to about 50 wt. % of water.

One embodiment of the present invention, Method A, comprises the steps: (a) dry blending tobacco particles with binder, filler, foaming agent, cross-linking or stiffening agent, and any other desired ingredient; (b) admixing this dry blend with water to form a wet blend; and (c) extruding the wet blend through a die having a plurality of holes in accordance with one of the extrusion conditions set forth above so as to foam each strand and adhere the strands to one another.

An alternate and preferred embodiment, Method B, comprises the steps (1) dry blending tobacco particles with filler, foaming agent, crosslinking or stiffening agent, and any other desired ingredient, (2) prehydrating the binder material with water or similar solvent to activate the adhesive character of the binder, (3) admixing the dry blend and the prehydrated binder to form a wet blend, and (4) extruding the wet blend through a die having a plurality of holes under any of the extrusion conditions set forth above so as to foam each strand and adhere the strands to one another.

Referring to Method A, blending the tobacco, binder, filler, foaming agent, cross-linking or stiffening agent, and other desired ingredients in step (a) may be carried out in any conventional mixing device. The dry blend from step (a) is then admixed in step (b) with water to form a wet blend containing from about 15 to about 50 wt. % of water. Step (b) is carried out in a conventional mixing device, such as a horizontal mixing cylinder, and it is preferred to employ a low shear mixing device.

Referring to Method B, step (2), prehydrating the binder and other desired materials with water or similar solvent, can be carried out in any conventional mixing device. Similarly, step (1), dry blending of tobacco particles, filler, and other desired materials, can be carried out in any conventional mixing device. Step (3), admixing the prehydrated binder from step (2) and the dry blend from step (1) can also be done in a conventional mixing device. In this context, the resulting wet blend can then be fed to the feed chamber of the extruder as described in greater detail below. In a preferred embodiment, Method B is used in conjunction with a twin screw positive mass displacement extruder having multiple feed ports. Step (2) prehydration is performed by adding the binder materials to a first feed port of the extruder and by adding the water or similar solvent to a second feed port a distance downstream of the first feed port so that as a charge of binder is inserted, it is processed, sheared, and homogenized as it progresses down the extrusion barrels. Then it is admixed with the water as it passes the second port, prehydrating the binder as the materials are displaced down the extruder barrel. Step (1), dry blending the tobacco, filler, and other materials occurs in a conventional mixing device and is added in a blended state to the extruder barrel by a third feed port, a distance downstream of the second port. Thus the prehydrated binder material from step (2) is admixed with the tobacco and other materials from step (1) in a continuous feed process.

The amount of water present in the wet blend is important. If the water content is reduced to less than about 15 wt. %, shear at the die may increase so much that the surface of the extruded product becomes porous and rough and results in a less than desirable degree of foaming. At water contents in excess of about 50 wt. % insufficient energy may be supplied to the formulation to generate sufficient foam as the product exits the die. Also, more energy maybe required to dry the product to a useable condition or to cause the strands to foam. Too little or too much water also prevents the extruded strands from adhering to one another to the proper degree to form a coherent multistrand article with the desired, preferably randomized, passageways. A post-extrusion drying chamber may be provided for drying the product to the desired temperature and moisture level to achieve the desired porous structure. Preferably, the drying chamber comprises a microwave cavity and the product is exposed to microwaves for an appropriate time to obtain a smoking article having the desired density.

Tobacco particles typically are generally more hygroscopic than binder, absorbing water at a faster rate. Any water absorbed by the tobacco in excess of the desired final moisture content of between 5 and 20 wt. % must be removed, typically by drying, for example, using microwave energy. Further, the lower the moisture content of the resulting extrudate, the easier the extrudate will be to handle and the less energy will be required to dry the extrudate.

In Method A, water or a similar solvent is added to a dry blend of binder and tobacco and other materials. In Method B, water or a similar solvent is added to the dry binder first, before the bulk, if not all, of the tobacco is added. Relatively less water or solvent may be required in Method B than in Method A to activate the adhesive character of the binder materials because in Method B, the binder materials may not have to compete with any or any significant amount of tobacco to utilize the water or solvent. Thus, Method B is preferred because by prehydrating the binder, the water or similar solvent is delivered to the binder where it is most needed, reducing the overall amount of water required to have the same strength product as obtained by Method A.

A further consequence of prehydration is that because the binder is exposed to most of the water or similar solvent without significant competition, it becomes more fully activated in both quantity and quality than the binder in accordance with Method A. Therefore the amount of binder required to hold the extrudate together may be significantly reduced to achieve the same strength extrudate as found by the application of Method A. Reducing the amount of binder used is not only more economical, but it also enhances the subjective factors of a smoking article, taste, feel, aroma, color, and quality of smoke. The less binder used, the more favorable the subjective factors will be.

Method B prehydration produces a significantly more activated binder material than Method A, and as a result the prehydrated binder is also more viscous. Because some extruder and mixing apparatus cannot generate the forces necessary to process and extrude the smoking article in accordance with this invention by the application of Method B, it may be advantageous to dry blend with the binder a small amount of tobacco particles, preferably an amount less than 5 wt. % of the tobacco, a small amount of filler, or other added component, and then prehydrate the blended binder and tobacco or other components. The resultant wet blend will have a lower viscosity than if no tobacco or other component were present and may be more easily processed without significantly raising the moisture content of the mass.

Also, because the viscous prehydrated binder can become very sticky and adhere to the mixing equipment, it is advantageous to dry blend with the binder a small amount of tobacco particles, filler material, or both. The amount of tobacco added is preferably less than about 5 wt. % of the tobacco. The dry blend is then prehydrated, resulting in a wet blend that has a reduced tendency to stick to the processing equipment and is relatively easier to process uniformly, as the material progresses from one step to the next.

Alternately, a portion of the binder may be dry blended with the tobacco and the balance of the binder prehydrated. Because of the relative surplus of water or similar solvent (later taken up by the dry blended tobacco and binder), the viscosity will be lower and the mass easier to handle. Although having a somewhat higher moisture content than without cross mixing tobacco and binder in steps (1) and (2), the more efficient activation of the binder results in a dryer and stronger extrudate than that made by the application of Method A.

The wet blend, Method A step (c) or Method B step (4), is fed into an extruder and processed as set forth in greater detail below. The extruder may be a single screw cooking extruder, which is a high temperature/-short residence time extruder that is essentially an Archimedean pump. That type of extruder has been employed in the food industry. Other suitable extruders are hydraulic piston extruders, ram extruders, extruders employing an extrusion chamber consisting of a male auger and a sleeve which incorporates a female auger, a spacer ring, and a face plate (or die) and extruders employing twin screws having a positive mass displacement extrusion action. It is important that the tobacco particles, the binder, and any additional ingredients be mixed to form a homogeneous mixture prior to extrusion. It may be desired to add water at one or more points along the extruder barrel to control the moisture content of the mass, for example, above 15% OV.

Optionally a foaming agent may be added to the blend in any of Method A steps (a–c) or Method B steps (1–4). The foaming agent is preferably selected from the group consisting of air, nitrogen, carbon dioxide, nitrous oxide, ammonium carbonate, ammonium carbamate, an azide, a hydrazide, pentane, hexane, heptane, a halogenated fluorocarbon, pyrrole, acetone, ethanol, a peroxide, and azodicarbonamide. Some of these foaming agents may require the addition of an acid or a base for decomposition.

The feeding bin is a common starting point for extruder systems. It is usually located near the extruder and its purpose is to provide a continuous source of raw ingredients for the rest of the extruder system. The feeding bin receives material from a conventional mixer/surge system and it usually feeds a variable speed metering/feeding device. A simple gravity bin with bottom discharge may be used as the feeding bin for the ingredients employed in a dry blending step.

Referring to Method A, a variable speed metering-/feeding device is usually employed to transport the dry blend from the feeding bin to the extruder. Water may then be added either at the point of entry to the extruder or at one or more locations along the extruder barrel. Vibratory feeders and variable speed screw feeders are two commonly used metering/feeding devices.

An intermediary processing device such as a horizontal mixing cylinder with either a single shaft or twin counter-rotating shafts, may be utilized to admix the water with the dry blend in step (b). Continuous mixing of the dry blend with the water is accomplished in the cylinder, and from this cylinder the wet blend is fed directly into the extruder barrel. Alternately, hydration of the dry blend from step (b) could occur within the extruder barrel by the addition of sufficient water at a controlled rate of feed, correlating with the rate of feed of the dry blend from step (b), either at the point of entry, or downstream of the dry binder feed.

Referring to Method B, when a multiple feed port extruder is selected, each of the mixing steps can be carried out in a separate conventional mixer/surge system having variable speed metering/feeding devices to provide the desired blend to the extruder. For example, in Method B, the binder materials could be mixed at one station and fed to a first port under a controlled rate of feed. At a second station, the tobacco, filler, and other material could be mixed and similarly fed to a second port downstream of the first port, also at a controlled rate of feed. Water could be added in controlled amounts to prehydrate the binder at a location before the tobacco blend material is introduced into the extruder barrel, and added elsewhere if necessary, to control the moisture content.

When a single feed port extruder is available, the binder could be first prehydrated in an intermediary processing device. Then the tobacco, filler, and other materials, having first been dry blended in a separate device are introduced to the intermediary processor for admixture, and the resulting wet blend then fed directly to the extruder barrel.

The extruder barrel may be built in segments or sections, with the individual screws being separated by steam locks. That gives each section its own discrete processing capability. Within the feed zone of the extruder barrel, the raw material exists as discrete particles. As these particles are transported forward in the feed zone, there is a positive pumping action with some compression of the material. This compression pushes the particles together into a more solid homogeneous mass.

As the material advances toward the die and into an additional zone or zones, this compression is continued and the material is subjected to mixing and mild shear, resulting in heating of the mixture until the particles are transformed into a dough-like mass. There is still a positive pumping effect in these zones that is usually somewhat less positive than in the feeding zone.

As the mixture advances toward the final zone before the die, the extruder barrel becomes completely filled with product. Leakage flow and pressure flow are greatest within this final zone, resulting in higher viscous shearing. That yields maximum heat generation. Heat is generated by the particles rubbing against one another and by the relative motion of the mixture against screw and wall surfaces.

The final die has two major functions. The first is to offer resistance to the forward flow of the mixture, thereby creating a condition where leakage flow and pressure flow may occur. The second is to shape the final product. Flow resistance of the die is the greatest factor in the heating of the mixture because the flow resistance has the greatest control over the pressure (and, therefore, the shear) within the barrel. Preferably, the pressure at the inlet of the die is from about 50 to about 2500 psig, more preferably from about 150 to about 1500 psig.

In the process of the present invention, it is preferred to employ a die having a plurality of holes, typically from about 10 to about 30 holes, each ranging in size from about 0.010 inches (0.254 mm) to about 0.050 inches (1.27 mm) in diameter. The combination of the number of holes and size of each hole is chosen to give the desired diameter and shape of the smoking article. The holes need not be of the same size or shape. A typical hole pattern will be described below. A die having centrally located holes and an outer annular opening may be used. The material extruded through the annulus will form what may be considered a wrapper for the co-extruded strands.

Typically, foaming of the product occurs immediately after extrusion. Foaming is a result of the moisture, other foaming agent, or gas within the extrudate changing from a super-heated liquid or compressed gas to a gas at essentially atmospheric pressure as the extrudate leaves the high-pressure environment behind the die inside the extruder and enters the atmospheric environment just downstream of the die openings. Alternatively, foaming of the product may occur after the extrudate has been extruded into the plurality of strands by passing the co-extruded strands through a drying chamber such as a microwave cavity or other device for heating the strands so that they foam. The drying process typically heats the strand surfaces so that they become tacky and adhere to each other along their length, forming a rope. In other situations, the strands also may adhere to one another by the application of an adhesive or other special processing conditions that will cause the surfaces of the strands to become tacky so that the strands adhere together along their outer surfaces.

The process will be further described with reference to the preferred extruders although other types of extruders may be effectively employed. One preferred extruder is the Wenger Model X20, a six-zone extrusion screw/barrel unit, commercially available from Wenger Manufacturing, Sabetha, Kansas. Various parameters for each zone are set forth in the following table.

| Zone | Screw Type/Wenger No. | Barrel Type/Wenger No. |
|---|---|---|
| 1 | Inlet/68638 | Inlet/68714 |
| 2 | Single flight/68327 | Straight rib/68318 |
| 3 | Single flight/68327 | Straight rib/68318 |
| 4 | Double flight/68326 | Spiral rib/68372 |
| 5 | Double flight/68326 | Sprial rib/68372 |
| 6 | Tapered tip/68321 Low | Tapered spiral/68350 |

Zones 1, 2, and 3 knead the extrusion mixture to develop elasticity and hydrate the gum (binder). Zones 4, 5, and 6 work the mixture by shear. If the Zone 6 screw is not tapered, the mixture will be overworked. The multistrand die is attached to the end of Zone 6.

A ⅛-inch (3.175 mm) thick spacer having an inner diameter equal to that of the Zone 6 barrel is used between the exit of Zone 6 and the die inlet. If a ¼-inch (6.35 mm) thick spacer is used, some of the mixture tends to collect in the spacer, and collected material will occasionally exit the die in the form of lumps. Furthermore, with the ¼-inch spacer and for the preferred mixture, the extrudate will be underworked, appear wet, and expansion will be insufficient. If no spacer is used, it is possible the extrudate will be overworked and darkened by cooking caused by the overworking, and expansion will be decreased. Thus, there is an optimal range for working of any particular extrusion mixture, outside of which less desirable articles are produced.

The product is transported through the extruder barrel by the extruder screws, complemented by the closure around the screw. The extruder barrel is jacketed, and the jacket is designed for either electrical heating or the circulation of water, steam, or other liquid thermofluid. That permits adjustment of the temperature profile of the extruder barrel by, for example, controlling the flow of cooling water in the jacket. Most of the thermoenergy within the extruder is created by the conversion of the mechanical energy into heat.

For continuous operation it is preferred to establish and maintain a temperature gradient that increases along the length of the extruder barrel. The maximum temperature will be at or just before the die. The temperature gradient will be within the range of from about 10° to about 300° C. and preferably from about 50° to about 250° C. Usually, thermocouples are inserted through the head into the flow channel and are connected to either temperature indicators or to automatic temperature control systems.

Each of the six zones of the Wenger X20 unit can be heated or cooled. The temperatures of Zones 1–5 are not critical, and should be high enough for the mixture to flow through the extruder but less than about 230° F. (110° C.). The temperature of zone 6 should be between about 160° F. (71° C.) and 260° F. (127° C.). With the preferred extrusion mixture described below and when making a cigarette-type smoking article of this invention, the following cooling water exit temperatures have been measured:

| Zone | Temperature (°F. ± 10° F.) |
|---|---|
| 1 | Not measured but <90 |
| 2 | Not measured but <90 |
| 3 | 90 |
| 4 | 125 |
| 5 | 125 |
| 6 | 180 |

Turning to the drawings, FIG. 1 shows the end of typical extrusion barrel 20 with preferred die 22 having holes 24. (For clarity the barrel is represented schematically and without the jacket, cooling water tubing, thermocouple wires, or the means for removing the head to change the die.)

Figure 2:
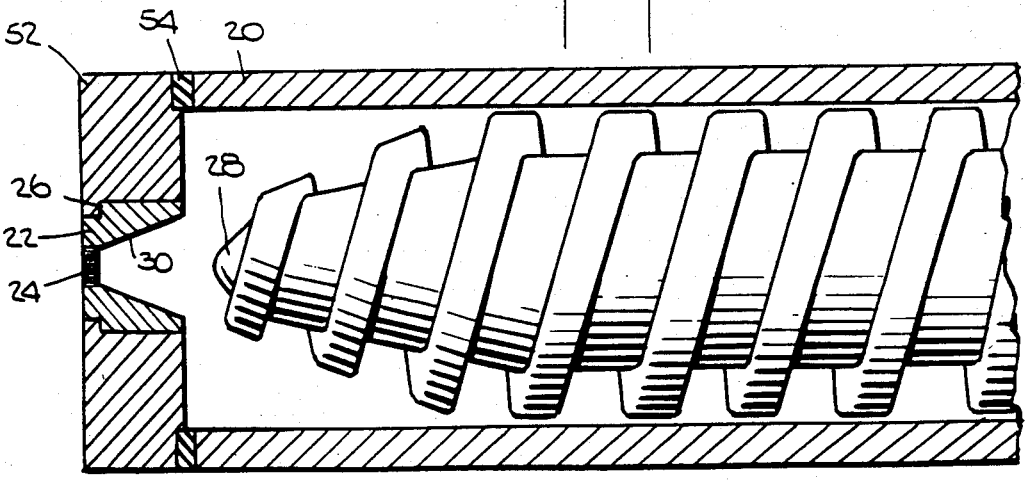
FIG. 2 is a side sectional view taken along line 2—2 of FIG. 1.

FIG. 2 shows screw 28 schematically in barrel 20. Shoulder 26 on die 22 (having internal conical surface 30) mates with a corresponding lip on head 52 and prevents die 22 from being forced out of the head. Spacer 54 lies between head 52 and barrel 20.

Figure 3:
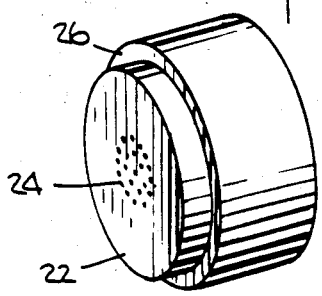
FIG. 3 is a perspective view of the die.
Figure 4:
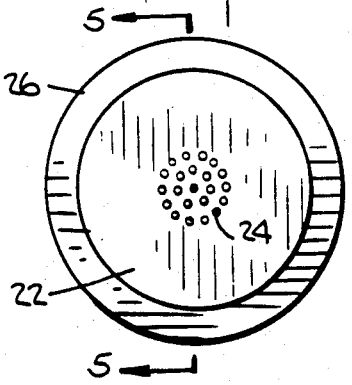
FIG. 4 is a front view of the die.
Figure 5:
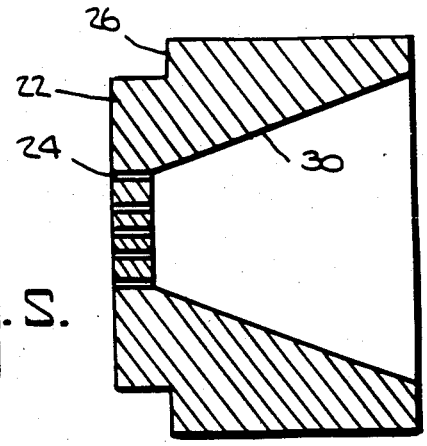
FIG. 5 is a side sectional view taken along line 5—5 of FIG. 4.

FIGS. 3, 4, and 5 are perspective, end, and side sectional views of die 22, respectively.

Figure 6:
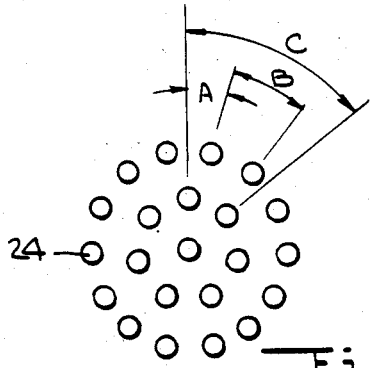
FIG. 6 shows the layout of the holes of the die.

FIG. 6 shows the layout of holes 24 of preferred die 22 for making cigarettes from the preferred blend. There are twenty-two holes, each 0.033–0.035 inches in diameter. There is one hole in the center, an inner ring of seven holes, and an outer ring of fourteen holes. Angle A is 12°-51′, angle B is 25°-43′, and angle C is 51°-26′. As will be apparent, these values have been rounded to the nearest minute. The inner ring is offset from (rotated with respect to) the outer ring so that no outer ring holes and either of the two nearest inner ring holes falls on a line with the center hole. That is to prevent any excessive channeling in the final product. The centers of the holes in the inner and outer rings fall on the circumferences of imaginary circles 0.128 inches (3.25 mm) and 0.256 inches (6.5 mm) in diameter, respectively. The center of each imaginary circle is the center of the single central hole of the die, that is, the one central hole, the inner ring, and the outer ring are concentric. The preferred die has a land length (length of holes through the die face) of ⅛ inch (3.175 mm).

Figure 7:
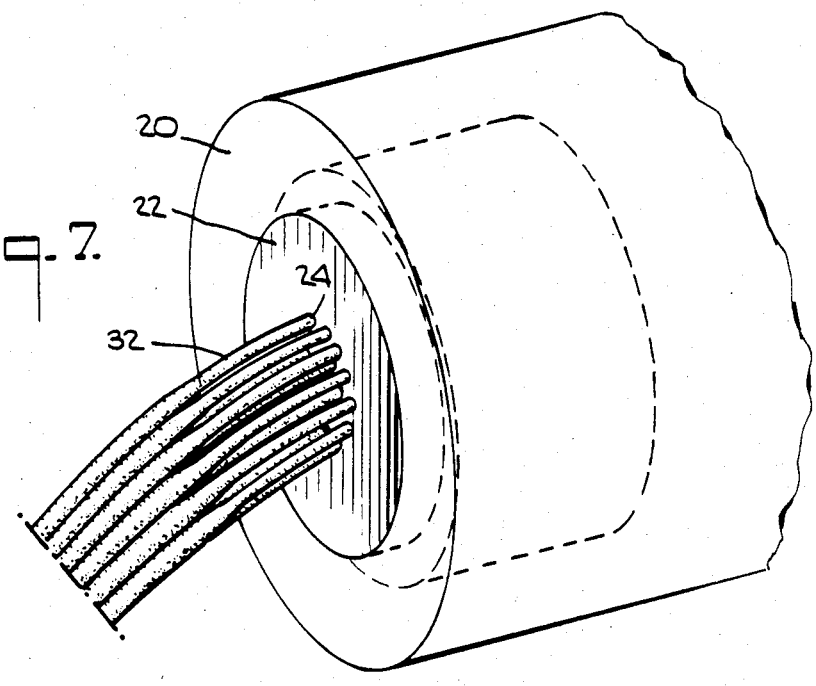
FIG. 7 is a perspective view showing the steaming strands of tobacco-containing material leaving the extruder barrel of FIG. 1.

In FIG. 7, strands 32 of extruded material are shown leaving die 22 through holes 24. Upon leaving the die, the strands expand and then contact and adhere to one another. The moist rope of the adhered strands cools and starts to harden quickly. The rope may be twisted to further increase the tortuosity of the passageways in the article. The rope may be collected on a non-stick surface and then sent to a drier.

Drying may be accomplished in any suitable manner. Microwave heating is preferred because of uniformity in drying along the radial direction. Drying desirably reduces the water content of the rope made by the application of Method A from about 25–35 wt. % at the die exit to about 12–15 wt. %.

In the application of Method B, the water content of the rope of strands is desirably reduced from about 20–35 wt. % at the die exit to about 12–15 wt. %.

Figure 8:
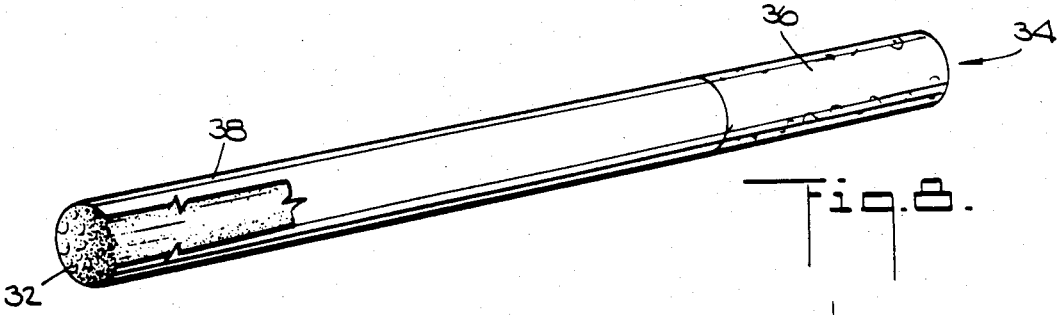
FIG. 8 is a perspective view showing a smoking article of this invention.

After drying, the rope may be wrapped, cut, and tipped with a filter to produce a cigarette as shown in FIG. 8. Cigarette 34 comprises tobacco rod 38 and filter 36.

Figure 9:
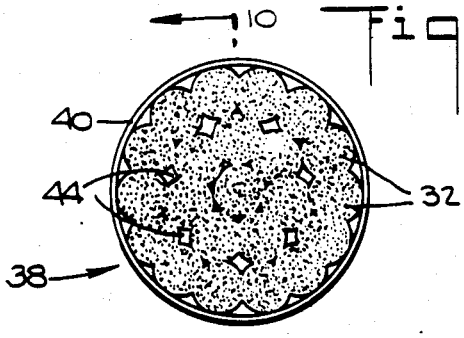
FIG. 9 is an end view of the distal end of the smoking article.

FIG. 9 is an end view of tobacco rod 38 of cigarette 34. Passageways 44 lie between strands 32. The circumference of strands 32 is not completely circular because of deformation at the points of contact (and adherence) of the strands to one another.

Because of microvariation in the composition and particle sizes of the mixture exiting each hole of the die and because of microvariations in the pressures just upstream of each die hole, the extruded, foamed strands in the preferred embodiment have generally smooth but slightly irregular surfaces. The irregularity is typically random and a principal cause of the randomness of contact of adjacent strands. Normally, the contact occurs almost immediately after the strands leave the die, and because of the tackiness of the material, adherence is immediate upon contact. If the strands do not expand sufficiently (e.g., because of over- or underworking or too much or too little water) or if the material does not have sufficient tackiness (e.g., because the strands are too dry, too cold, or the binder is not satisfactory), the desired contact and adherence will not occur and the article will not have the desired network of passageways without post-extrusion processing.

The holes of the die should not be too far apart, otherwise the extruded strands will not be able to contact on another soon enough after leaving the die for sufficient adherence to occur. If the velocity of the exiting strands is too high, the strands may cool too much before they can contact and adhere sufficiently to one another. Also, the linear velocity of the strands exiting the die should be substantially uniform so that there is as little linear motion of the strands with respect to one another as possible. To achieve this uniform velocity may require the die having holes of different sizes, depending on the particular extruder used and its particular pressure profile just upstream of the die.

In accordance with the post-extrusion processing of the strands, the spacing of the holes and the temperature of the strands as extruded may be less important for causing the strands to adhere to each other because heat sufficient to cause the strands to become tacky and adhere is imparted to the product while it is heated in the drying chamber or, in other circumstances, an adhesive or other manufacturing condition is applied to cause the adjacent strands to adhere to one another.

Figure 10:
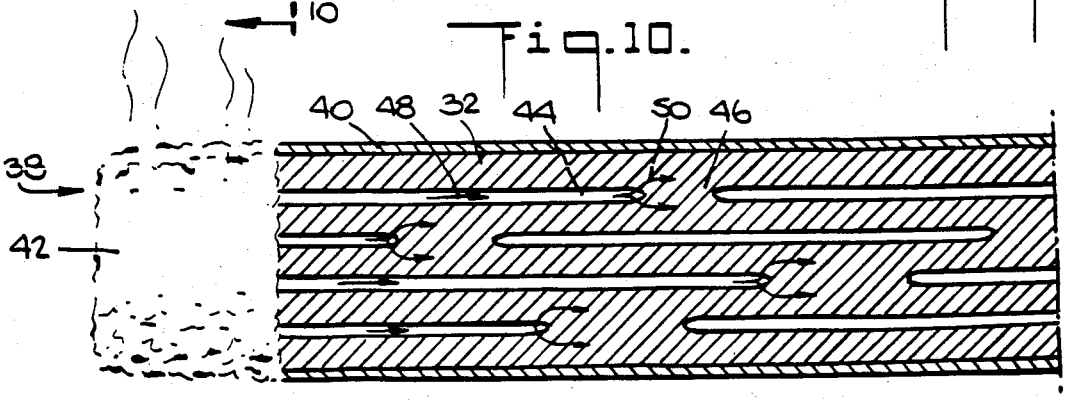
FIG. 10 is a side sectional view taken along line 10—10 of FIG. 9.

FIG. 10 is an enlarged view of a portion of tobacco rod 38 having wrapping paper 40, coal 42, and passageways 44. Arrow 48 indicates the flow of smoke to the end of the cigarette proximal to the smoker. When that smoke reaches an area of adherence 46 of one strand to another, the smoke finds passageway 44 blocked and may travel towards the smoker as indicated by arrows 50.

Other extruding equipment and conditions were used and, for the same or similar conditions, resulted in poorer results as measured by some product parameters. For example, insufficient mixing, inadequate foaming, and a feathered exterior appearance occurred in some instances. The inventors believe that the results recited herein are exemplary of their invention and that the poorer results occasionally obtained should be viewed as aberrational results due to equipment limitations.

Example I

To illustrate preparation of smoking articles within this invention, the preferred extruding composition was prepared and extruded in accordance with Method A. That composition was made by first dry blending 90 wt. %: Tobacco dust 5 wt. %: Hydroxypropyl cellulose (Klucel® HF from Hercules, Inc.)

2.5 wt. %: Carboxymethyl cellulose (CMC 7 HF from Hercules, Inc.)

2.5 wt. %: Starch (Lincoln pre-gelatinized corn cereal binder #201F. from Lincoln Grain, Inc. in Atchison, Kan.)

and loading that mixture into the feed hopper of a preferred extruder, the Wenger X20 unit described above. The tobacco dust was a mixture of burley, bright, and oriental tobacco particles, essentially all of which were less than 80 mesh in size.

The extruder feeder speed was set at rpm, which corresponds to about 136 pounds per hour of dry mixture, and the mixing cylinder speed was set at 300 rpm. To show the effect on product properties of the amount of water used in making the wet blend, the effect of extruder barrel temperature, and the effect of variations in extruder speed (working of the mixture), comparative runs were also performed. In all runs the Wenger X20 unit, the preferred die, and a ⅛ inch spacer between Zone 6 and the die were used.

The extruded ropes (if formed) were dried, wrapped (if possible), cut to rods 63 mm in length, and joined to a filter (if possible). The run conditions and results are shown in the table below.

TABLE I

| Run | 591 | 591A | 591B | 591C | 591D | 591E | 591F | 591G | 591H | 591I |
|---|---|---|---|---|---|---|---|---|---|---|
| Temperature (°F.) | | | | | | | | | | |
| Zone 2 | 121 | 108 | 108 | 101 | 101 | 101 | 111 | 105 | 100 | 114 |
| Zone 3 | 129 | 125 | 140 | 142 | 142 | 142 | 143 | 143 | 143 | 141 |
| Zone 4 | 104 | 104 | 102 | 107 | 107 | 107 | 106 | 106 | 106 | 109 |
| Zone 5 | 190 | 192 | 194 | 181 | 181 | 181 | 180 | 184 | 184 | 194 |
| Water Feed | | | | | | | | | | |
| rotameter | 57.5 | 54 | 50 | 74 | 70 | 68 | 65 | 62 | 60 | 58 |
| lbs/hr. | 32.0 | 34.5 | 28.0 | 45.0 | 42.0 | 41.0 | 39.0 | 35.5 | 34.0 | 32.5 |
| Extruder | | | | | | | | | | |
| rpm | 400 | 400 | 400 | 400 | 400 | 400 | 400 | 400 | 400 | 400 |
| amps | 20 | 20 | 20 | 19 | 19 | 19 | 19 | 19 | 19 | 20 |
| Moisture of extruder feed (% OV) | 28.4 | 27.9 | — | — | — | — | 36.5 | 32.0 | 29.6 | 35.5 |
| Rope at die exit | | | | | | | | | | |
| lbs/hr | 129 | 126 | — | — | — | — | 132 | 135 | 132 | 126 |

TABLE I-continued

| | | | | | | | | | | |
|---|---|---|---|---|---|---|---|---|---|---|
| moisture (% OV) | 28.8 | 26.6 | — | — | — | — | 32.3 | 31.7 | 30.0 | 29.0 |
| diameter (mm) | 8.3 | 8.0 | — | — | — | — | — | — | 8.4 | 8.5 |
| strands adhere? | Yes | Yes | No | No | Some | Some | Yes | Yes | Yes | Yes |
| strands expand? | Yes | Yes | Yes | Some | Some | Some | Some | Some | Yes | Yes |
| Dried Product | | | | | | | | | | |
| weight (g) | 0.932 | 0.950 | — | — | — | — | — | 0.988 | 1.069 | 0.977 |
| circum. (mm) | 25.1 | 23.29 | — | — | — | — | — | 23.33 | 24.91 | 23.38 |
| RTD with filter (inches water) | ca. 4.0 | ca. 4.0 | — | — | — | — | — | — | — | — |
| acceptable? | Yes | Yes | — | — | — | — | Yes | Yes | Yes | Yes |

| Run | 591J | 591K | 591L | 591M | 591N | 591O | 591P |
|---|---|---|---|---|---|---|---|
| Temperature (°F.) | | | | | | | |
| Zone 2 | 116 | 116 | 102 | 123 | 138 | 117 | 113 |
| Zone 3 | 147 | 150 | 130 | 131 | 144 | 138 | 136 |
| Zone 4 | 112 | 116 | 105 | 104 | 113 | 109 | 110 |
| Zone 5 | 201 | 207 | 188 | 180 | 199 | 225 | ca. 245 |
| Water Feed | | | | | | | |
| rotameter | 58 | 58 | 58 | 58 | 58 | 58 | 58 |
| lbs/hr. | 32.5 | 32.5 | 32.5 | 32.5 | 32.5 | 32.5 | 32.5 |
| Extruder | | | | | | | |
| rpm | 450 | 570 | 350 | 300 | 500 | 400 | 400 |
| amps | 20 | — | 20 | 20 | 19 | 20 | 20 |
| Moisture of extruder feed (% OV) | — | — | — | — | — | — | 30.3 |
| Rope at die exit | | NP* | | | | | |
| lbs/hr | 126 | — | 129 | 129 | — | — | — |
| moisture (% OV) | — | — | — | — | — | 29.7 | — |
| diameter (mm) | 8.5 | — | 8.5 | 8.3 | — | 8.3 | 7.6 |
| strands adhere? | Yes | — | Yes | Yes | No | Yes | Yes |
| strands expand? | Yes | — | Yes | Yes | — | Yes | Some |
| Dried Product | | | | | | | |
| weight (g) | 0.959 | — | 1.053 | 1.077 | — | 0.948 | 0.887 |
| circum. (mm) | 23.61 | — | 24.18 | 23.98 | — | 23.23 | 22.23 |
| RTD with filter (inches water) | — | — | — | — | — | — | — |
| acceptable? | Yes | — | Yes | Yes | No | Yes | Yes |

*"NP" means no product-insufficient flow of material from mixer to extruder.

Runs 591 and 591A-I show that either too much (591C, D, D) or too little water (591B) in the mixture in the die feed results in poor expansion and/or poor adhesion of the extruded strands. Comparison of Runs 591 and 591J-N show that too much working (591K) of the mixture in the extruder prevents proper expansion and/or adhesion of the strands.

A more preferred extruder is the commercially available Baker-Perkins Twin Screw extruder, Model No. MPF50D (or MPF50L). Baker-Perkins is located in Raleigh, N.C.

EXAMPLE II

The following examples were extruded in a Baker-Perkins twin screw extruder, Model MPF-50D, having a 1263.6 mm long extrusion chamber, wherein the two screws had the same assemblage of components, as follows:

| Length | Screw Assembly Elements |
|---|---|
| 6.325 mm | Spacer |
| 508 mm | Spacer |
| 152.4 mm | Feed screw |
| 63.5 mm | Five 45° forwarding paddles |
| 50.8 mm | Short pitch feed screw |
| 177.8 mm | Feed screw |
| 12.7 mm | One paddle |
| 50.8 mm | Single lead screw |
| 63.5 mm | Five 45° forwarding paddles |
| 6.35 mm | One orifice plug |
| 50.8 mm | Single lead screw |
| 6.35 mm | One paddle |
| 101.6 mm | Single lead |
| multihole die | 22 holes about .889 mm diameter in a |

-continued

| Length | Screw Assembly Elements |
|---|---|
| | die face about 25.4 mm in diameter |

The screws were rotated so as to be 90° out of phase to prevent interfering with each other and to provide a tolerance between the screws of about 50/64 mm. The Baker-Perkins extruder has multiple feed ports along its length so auxillary mixing equipment was not required as it was the case in the Wenger extruder. The binder was added at a distance 15:1 length:diameter ("L/D") screw length measured from the extrusion end (die), the water used to prehydrate the binder was added at a distance 12:1 (L/D) from the die, and the tobacco dust was added at a distance 10:1 (L/D) from the die. The binder mixture used consisted of the following blend:

1 part: Hydroxypropyl cellulose (Klucel-H® from Hercules, Inc.)
4 parts: Hydroxypropyl guar (Galaxy 781® from Henkel Corp.)
5 parts: Starch The results of the various extrusions are set forth in Table II below.

The products of runs c, d, and e, made in accordance with Method B prehydration of binder technique, were much stronger and better in appearance than the product made by the non-prehydrated Method A, run a, even though they contained a significantly lesser amount of binder. In addition, using Method B and prehydrating the binder allowed for the extrusion of a drier extrudate by using a lesser amount of water. Run "a", made in accordance with Method A, could not produce a satisfactory product with a lesser amount of water or a lesser amount of binder than used in example.

TABLE II

| Run | Screw speed (RPM) | Wt. % of binder | Feed rate of binder (Kg/min) | Feed rate of water (Kg/min) | Feed rate of tobacco dust (Kg/min) | OV in mixing chamber (%)**** | OV of extrudate (%) | Weight of extrudate/ 63 mm |
|---|---|---|---|---|---|---|---|---|
| a* | 490 | 12.7*** | .1134 | .2077 | .816 | 28.4 | 18.7 | 1177 |
| b* | 490 | 10*** | .0907 | .2077 | .816 | 28.4 | ** | ** |
| c | 490 | 10 | .0907 | .1837 | .816 | 26.8 | 16.3 | 1241 |
| d | 490 | 9.1 | .0816 | .1700 | .816 | 25.9 | 15.9 | 1251 |
| e | 490 | 8.2 | .0816 | .2009 | .816 | 28.0 | 17.2 | 1204 |

*Runs a and b are the controls and were made in accordance with Method A, adding the tobacco and the binder blend to the extruder at the 15:1 L/D position and adding the water at the 12:1 L/D position (the same location as per examples c, d and e, made in accordance with Method B where the water was added to the binder blend in the prehydration mode).
**The amount of binder used in this run did not yield a strong enough product to collect for testing at these particular extrusion conditions.
***The amount of binder used represents the minimum amount of binder that could be used to produce an acceptable result.
****The OV values in the mixing chamber were calculated based on pump feed rates of the materials.

We claim:

1. An extruded, coherent, multistrand, tobacco-containing, generally cylindrical smoking article comprising a plurality of co-extruded strands that extend generally along the longitude of the smoking article and are adhered to one another so as to leave flow passageways between the strands, which passageways extend generally along the longitude of the smoking article, the configuration of the strands and passageways providing sufficient heat transfer area or sufficient residence time or both for the hot gases drawn towards the proximal end of the smoking article by a smoker to cool and to exit the proximal end at a comfortable temperature for the smoker, the smoking article also comprising (a) from about 5 to about 98 wt. % of tobacco particles having a particle size of up to about 5 mesh, (b) from 0 to about 60 wt. % of a filler having a particle size of up to about 350 μm, (c) from 0 to about 1 wt. % of a residual foaming agent other than water, (d) from about 2 to about 40 wt. % of a binder selected from the group consisting of cellulosic binders, natural binders, modified natural binders, synthetic binders, and mixtures thereof, and (e) from about 5 to about 20 wt. % water, the article having a density within the range of from about 0.05 to about 1.5 g/cc.

2. The smoking article of claim 1 wherein the filler is selected from the group consisting of calcium carbonate, magnesium carbonate, calcium oxide, magnesium oxide, calcium hydroxide, magnesium hydroxide, metallic aluminum, alumina, hydrated alumina, clay, silica, diatomaceous earth and mixtures thereof.

3. The smoking article of claim 1 wherein the cellulosic binder included in the mixture in an amount from about 0 to about 40 wt. % is selected from the group consisting of hydroxypropyl cellulose, carboxymethyl cellulose and its ammonium, sodium, and potassium salts, cross-linked carboxymethyl cellulose and its ammonium, sodium, and potassium salts, hydroxyethyl cellulose, ethyl hydroxyethyl cellulose, hydroxypropyl methyl cellulose, methyl cellulose, ethyl cellulose, and mixtures thereof.

4. The smoking article of claim 1 wherein the natural binders, modified natural binders, and synthetic binders included in the mixture in an amount from 0 to about 40 wt. % are selected from the group consisting of pectin and its sodium, potassium, and ammonium salts, starch, guar and derivatives thereof, hemicellulose, xanthan, curdlan, a salt of xanthamonas gum, carageenan, alginic acid and its ammonium, sodium, and potassium salts, oxycellulose, polyvinyl alcohol, vinyl maleic anhydride polymer, vinyl maleic acid polymer and its sodium, potassium, and ammonium salts, microcrystalline cellulose, dextran, dextrin, fibrous cellulose, and mixtures thereof.

5. The smoking article of claim 1 further comprising from about 0.1 to about 15 wt. % of a polyfunctional acid or its ammonium, sodium, and potassium salts.

6. The smoking article of claim 5 wherein the polyfunctional acid is citric acid or a citrate.

7. The smoking article of claim 5 wherein the polyfunctional acid is phosphoric acid or a phosphate.

8. The smoking article of claim 1 further comprising from about 0.1 to about 40 wt. % of a cross-linking or stiffening agent selected from the group consisting of alginic acid, carboxymethyl chitin, pectinic acid, chitosan, water soluble salts thereof, and mixtures thereof.

9. The smoking article of claim 1 wherein the tobacco particles comprise about 25 to about 98 wt. % of the article.

10. A method of making an extruded, coherent, multistrand, tobacco-containing, generally cylindrical smoking article comprising a plurality of co-extruded strands that extend generally along the longitude of the smoking article and are adhered to one another so as to leave flow passageways between the strands, which passageways extend generally along the longitude of the smoking article, the configuration of the strands, and passageways providing sufficient heat transfer area or sufficient residence time or both for the hot gases drawn towards the proximal end of the smoking article by a smoker to cool and to exit the proximal end at a comfortable temperature for the smoker, the method comprising the steps of:

(a) mixing together from about 5 to about 98 wt. % of tobacco particles having a particle size of up to about 5 mesh and an OV value of from about 3 to about 20%, from 0 to about 60 wt. % of a filler having a particle size of up to about 350 μm, from 0 to about 50 wt. % of a foaming agent including any solvent or vehicle other than water, from about 2 to about 40 wt. % of a binder selected from the group consisting of cellulosic binders, natural binders, modified natural binders, synthetic binders, and mixtures thereof, and water to form a wet blend containing from about 15 to about 50 wt. % of water;

(b) extruding the wet blend from step (a) through a die having a plurality of holes to form a plurality of strands adhered together as a smoking article having a density within the range of from about 0.05 to about 1.5 g/cc.

11. The method of claim 10 further comprising twisting the plurality of coherent strands extruded through the die to increase the tortuousity of the flow passageways and to reduce the channeling effect of the hot gasses passing through the smoking article.

12. The method of claim 10 wherein step (b) further comprises extruding the wet blend from step (a) through the die under extrusion conditions of temperature and pressure such that as the wet blend is extruded, thereby forming a plurality of strands, (i) the moisture or other foaming agent in said blend is converted to steam or other gaseous product so as to foam each strand and (ii) the strands adhere to one another along their outer surfaces.

13. The method of claim 12 wherein in step (a) from about 0.1 to about 15 wt. % of a polyfunctional acid or its ammonium, sodium, and potassium salts is included in the mixture.

14. The method of claim 13 wherein the polyfunctional acid is citric acid or a citrate.

15. The method of claim 13 wherein the polyfunctional acid is phosphoric acid or a phosphate.

16. The method of claim 10 wherein step (b) further comprises extruding the wet blend from step (a) through the die so as to form a plurality of strands, drying the strands in a drying chamber to convert the moisture or other foaming agent to steam or other gaseous product and to cause the surface of the individual strands to become tacky and adhere to each other and thereby provide the preselected density of the article.

17. The method of claim 16 wherein the drying chamber further comprises a microwave cavity having a frequency responsive to the resonant frequency of the moisture or other foaming agent to convert them to a gaseous product.

18. The method of claim 10 further comprising adhering the strands to each other by applying a material to the individual strands to produce a tacky surface on the strands and contacting adjacent strands at points along their outer surfaces.

19. The method of claim 10 wherein the filler is selected from the group consisting of calcium carbonate, magnesium carbonate, calcium oxide, magnesium oxide, calcium hydroxide, magnesium hydroxide, metallic aluminum, alumina, hydrated alumina, clay, silica, diatomaceous earth, and mixtures thereof.

20. The method of claim 10 wherein the cellulosic binder included in the mixture in an amount from 0 to about 40 wt. % is selected from the group consisting of hydroxypropyl cellulose, carboxymethyl cellulose and its ammonium, sodium, and potassium salts, cross-linked carboxymethyl cellulose and its ammonium, sodium, and potassium, salts, hydroxyethyl cellulose, ethyl hydroxyethyl cellulose, hydroxypropyl methyl cellulose, methyl cellulose, ethyl cellulose, and mixtures thereof.

21. The method of claim 10 wherein the natural binders, modified natural binders, and synthetic binders included in the mixture in an amount from 0 to about 40 wt. % are selected from the group consisting of pectin and its sodium, potassium, and ammonium salts, starch, guar and derivatives thereof, hemicellulose, xanthan, curdlan, a salt of xanthamonas gum, carageenan, alginic acid and its ammonium, sodium, and potassium salts, oxycellulose, polyvinyl alcohol, vinyl maleic anhydride polymer, vinyl maleic acid polymer and its sodium, potassium, and ammonium salts, microcrystalline cellulose, dextran, dextrin, fibrous cellulose, and mixtures thereof.

22. The method of claim 10 wherein in step (a), from about 0.1 to about 40 wt. % of a cross-linking or stiffening agent selected from the group consisting of alginic acid, carboxymethyl chitin, pectinic acid, chitosan, water soluble salts thereof, and mixtures thereof, is included in the mixture.

23. The method of claim 10 wherein in step (a) from about 2 to about 40 wt. % of an alcohol selected from the group consisting of ethanol, methanol, isopropanol, n-propanol, and mixtures thereof is included in the mixture.

24. The method of claim 10 wherein in step (a) the tobacco particles comprise from about 50 to about 98 wt. % of the mixture.

25. A smoking article produced according to the method of claim 10.

26. The method of claim 10 wherein step (a) further comprises:

(1) dry blending (i) from about 5 to about 98 wt. % of tobacco particles having a particle size of up to about 5 mesh and an OV value of from about 3 to about 20% with (ii) from 0 to about 60 wt. % of a filler having a particle size of up to about 350 μm, (iii) from 0 to about 50 wt. % of a foaming agent including any solvent or vehicle other than water, and (iv) from about 2 to about 40 wt. % of a binder selected from the group consisting of cellulosic binders, natural binders, modified natural binders, synthetic binders, and mixtures thereof; and (2) admixing the dry blend from step (a) with water to form a wet blend containing from about 15 to about 50 wt. % of water.

27. The method of claim 26 wherein in step (1) from about 0.1 to about 15 wt. % of a polyfunctional acid or its ammonium, sodium, and potassium salts is included in the dry blend.

28. The method of claim 27 wherein the polyfunctional acid is citric acid or a citrate.

29. The method of claim 27 wherein the polyfunctional acid is phosphoric acid or a phosphate.

30. The method of claim 26 wherein in step (1), from about 0.1 to about 40 wt. % of a cross-linking or stiffening agent selected from the group consisting of alginic acid, carboxymethyl, chitin, pectinic acid, chitosan, water soluble salts thereof, and mixtures thereof, is included in the dry blend.

31. The method of claim 26 wherein in step (1) from about 2 to about 40 wt. % of an alcohol selected from the group consisting of ethanol, methanol, isopropanol, n-propanol, and mixtures thereof is included in the dry blend.

32. The method of claim 26 wherein in step (a) the tobacco particles comprise from about 50 to about 98 wt. % of the dry blend.

33. A smoking article produced according to the method of claim 26.

34. The method of claim 10 wherein step (a) further comprises:

(1) dry blending from about 5 to about 98 wt. % of tobacco particles having a particle size of up to about 5 mesh and an OV value of from about 3 to about 20% with from 0 to about 60 wt. % of a filler having a particle size of up to about 350 μm and from 0 to about 50 wt. % of a foaming agent including any solvent or vehicle other than water;

(2) prehydrating from about 2 to about 40 wt. % of a binder selected from the group consisting of cellulosic binders, natural binders, modified natural binders, synthetic binders, and mixtures thereof; and (3) admixing the dry blend from step (1) with the prehydrated binder from step (2) to form a wet blend containing from about 15 to about 50 wt. % of water.

35. The method of claim 34 wherein in step (1) from about 0.1 to about 15 wt. % of a polyfunctional acid or its ammonium, sodium, and potassium salts is included in the dry blend.

36. The method of claim 35 wherein the polyfunctional acid is citric acid or a citrate.

37. The method of claim 35 wherein the polyfunctional acid is phosphoric acid or a phosphate.

38. The method of claim 34 wherein in step (1), from about 0.1 to about 40 wt. % of a cross-linking or stiffening agent selected from the group consisting of alginic acid, carboxymethyl, chitin, pectinic acid, chitosan, water soluble salts thereof, and mixtures thereof, is included in the dry blend.

39. The method of claim 34 wherein in step (1) from about 2 to about 40 wt. % of an alcohol selected from the group consisting of ethanol, methanol, isopropanol, n-propanol, and mixtures thereof is included in the dry blend.

40. The method of claim 34 wherein in step (1) the tobacco particles comprise from about 50 to about 98 wt. % of the dry blend.

41. A smoking article produced according to the method of claim 34.

42. The method of claim 34 wherein a relatively small portion of the materials in step (2) in an unhydrated state, is added to and dry blended with the dry blend of step (1) to reduce the viscosity of the prehydrated binder from step (2) and to reduce the tendency of the prehydrated binder to stick to the processing equipment.

43. The method of claim 34 wherein step (2) further includes adding from about 0 to about 5.0 wt. % of the tobacco particles to the mixture to be prehydrated.

* * * * *